United States Patent [19]

Rivacoba et al.

[11] 4,191,495

[45] Mar. 4, 1980

[54] SEA PLATFORMS TO SUPPORT INDUSTRIAL INSTALLATIONS

[75] Inventors: Jose U. Rivacoba; Alberto T. Galdos, both of Bilbao, Spain

[73] Assignee: Sener, Ingenieria y Sistemas S.A., Madrid, Spain

[21] Appl. No.: 957,342

[22] Filed: Nov. 3, 1978

[30] Foreign Application Priority Data

Nov. 3, 1977 [ES] Spain ..... 463.817

[51] Int. Cl.[2] ..... E02B 17/02

[52] U.S. Cl. ..... 405/195; 52/167; 405/203; 405/229

[58] Field of Search ..... 405/195, 203, 204, 205, 405/206, 229, 207, 208, 209; 52/167

[56] References Cited

U.S. PATENT DOCUMENTS

| | | | |
|---|---|---|---|
| 2,217,879 | 10/1940 | Willey | 405/204 X |
| 2,688,848 | 9/1954 | Moon | 405/204 |
| 2,741,910 | 4/1956 | Thornley | 405/229 X |
| 3,943,724 | 3/1976 | Banzoli et al. | 405/205 X |
| 3,996,756 | 12/1976 | Schirtzinger | 405/205 X |
| 4,155,671 | 5/1979 | Vos | 405/203 |

FOREIGN PATENT DOCUMENTS

| | | | |
|---|---|---|---|
| 79199 | 10/1955 | Netherlands | 405/229 |

*Primary Examiner*—Dennis L. Taylor
*Attorney, Agent, or Firm*—Wigman & Cohen

[57] ABSTRACT

A marine platform supports industrial installations. The platform comprises a barge and a lower keel on which the barge rests. The keel is positioned on the ocean floor. Intermediate friction elements are situated between the contact surfaces of the barge and the keel. Elastic elements are interconnected to the barge and the keel. These elastic elements oppose displacements between the barge and the keel. The displacements are controlled because the friction resulting from the intermediate friction elements impedes movements between the barge and the keel. These movements may be caused by external forces acting on the barge, such as waves, currents, and winds, or may be caused by the effects of acceleration on the keel induced by an earthquake of small magnitude. The intermediate friction elements have means for permitting displacements between the barge and the keel in the case of an earthquake of great magnitude. The elastic elements have means for decreasing an elasticity constant in discrete degrees when the displacements surpass a predetermined value so that, as the intensity of the earthquake increases, the oscillation period of the barge on the keel increases too but amplication of the oscillation period is avoided.

11 Claims, 15 Drawing Figures

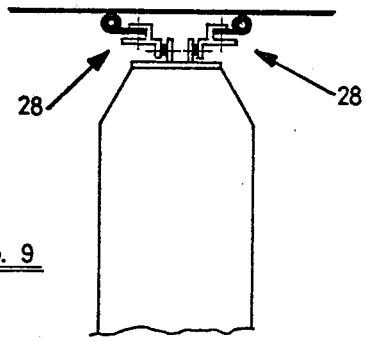
FIG. 9
FIG. 6
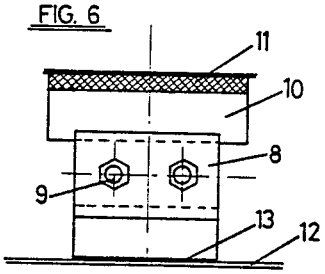
FIG. 7
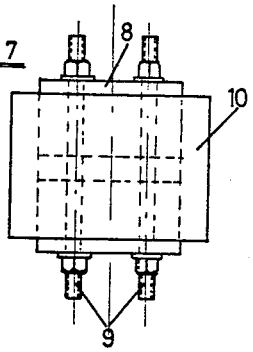
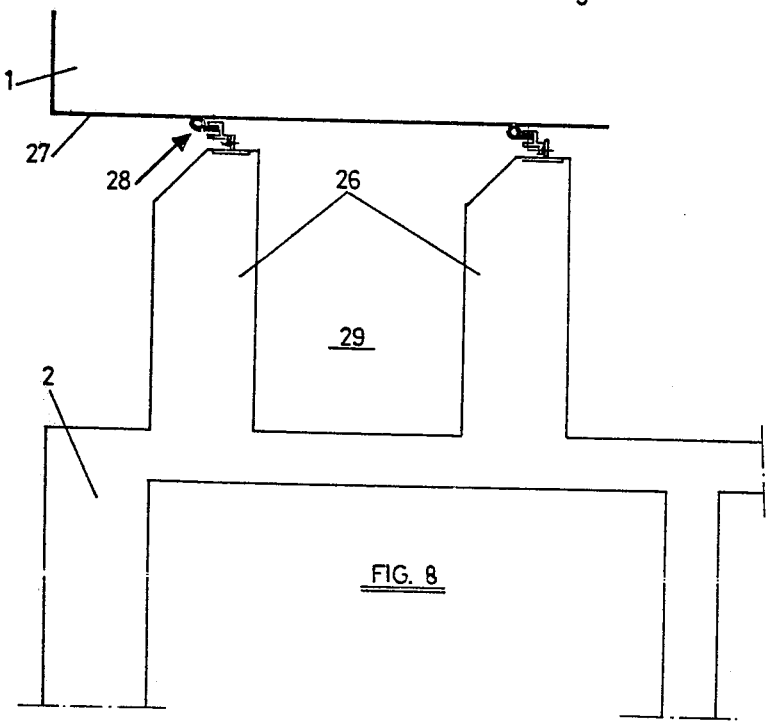
FIG. 8

SEA PLATFORMS TO SUPPORT INDUSTRIAL INSTALLATIONS

BACKGROUND OF THE INVENTION

1. Field of the Invention

This invention refers to marine platforms destined for use as supports for any type of industrial installations, such as warehouses, chemical or physical treatment plants, energy production sites, etc.

The invention is particularly adapted for marine platforms mounted in shallow water areas. Henceforth, shallow water areas shall mean areas where the water is no more than 40 meters in depth.

The invention is also applicable to floating land foundations in seismic areas, as will be explained hereinafter.

2. Description of the Prior Art

The feasibility of mounting certain installations on marine platforms is stirring greater interest day by day. This is due, in some cases, to the pollutant and hazardous aspects of certain plants, such as chemical installations in general, nuclear centers, etc., in other cases, to the facilitated loading and unloading of the treatment product when it is transported via ship, and, in still other cases, to areas where not enough land is available to mount the installation.

Even greater interest is aroused by platforms that are capable of floating and being transported with the mounted installation, inasmuch as this allows the construction and mounting of an industrial installation in an industrialized nation in such a way that the cost and time of delivery are kept to a minimum and may be forecast rather accurately. Then, the platform is floated to the delivery site, which, in many cases, is not equipped with the best means to construct and mount the installations.

Another advantage of industrial installations mounted on floating platforms is that they may be used in locations where their operation or installation will only be temporary. This may be the case in the utilization of prime materials coming from small deposits. The platform, together with its installation, may then be moved to another location.

Floating platforms are primarily conceived to operate in one of the following manners: floating or resting on the ocean floor.

Floating platforms present a disadvantage because of continual movements and possible displacements due to waves, currents, tides, and winds.

These displacements greatly complicate the connections for the transport of the treatment product to and from the platform, making it necessary to rely on extremely complex solutions, especially when the product in question is hazardous at high pressure or low temperature.

The problem becomes even more acute when the treatment product is transported to or from a ship, inasmuch as in addition to the possible movements of the platform, those of the boat must also be contended with.

Movements of the platform also require a modification of the procedures normally used on land, rendering the installation more costly. It may also be necessary to suspend its operation in the case of adverse maritime conditions.

Platforms that operate while resting on the ocean floor avoid the problems mentioned in relation to the floating platforms.

Spanish Pat. No. 451,827 describes a marine platform, capable of floating, and designed to operate while resting on the ocean floor in shallow water areas. It is constructed so that it may be floated up whenever necessary either for relocation by floating to another site or for inspection and maintenance purposes.

In accordance with said patent, the platform consists of a lower keel, made, e.g., of a concrete case, which rests on the ocean floor and a barge which, in turn, rests on the keel.

Both the barge and the keel have ballast tanks which allow foundering and floating, wherever desired, for transport to another location by flotation.

To avoid the appearance of certain stresses between the contact surfaces of the barge and the keel, a stratum of deformable material is placed on the keel, e.g., gravel or the like, assuring uniform contact between said barge and keel.

The keel shall be of a height that the barge with empty ballast tanks may float upon said keel. When the ballast tanks are full, the barge rests on the keel with enough pressure so as to hinder movements of the barge by external forces.

In other words, the barge and the keel remain connected due to the weight of the barge and the composition or nature of the deformable stratum placed between the barge and keel.

This system of mounting the barge presupposes that, in the case of an earthquake, both the horizontal and the vertical movements, as well as the amplified horizontal movements or oscillations, of the keel are transmitted entirely to the barge. These oscillations, particularly the horizontal, may endanger the stability of the installation mounted on the barge, even to the point of destruction should the earthquake be of a certain magnitude.

If the friction between the barge and keel were not enough to ensure that the barge would follow the keel in its oscillations due to earthquakes, the barge would undergo uncontrolled displacements and irreparable damage with respect to the keel, which displacements could even lead to the fall of the barge.

SUMMARY OF THE INVENTION

The object of this invention is precisely to avoid the disadvantages of the prior art, by connecting the barge and keel together so as to reduce the magnitude of the horizontal oscillations transmitted by the keel to the barge to such a degree that the integrity of the mounted installation of the barge would remain unaffected and, at the same time, possible displacements of the barge with respect to the keel, with recovery of the former, would be controlled.

To attain these goals, the barge and the keel are connected by discrete intermediate friction elements and elastic connection elements that oppose the sliding motions between barge and keel.

The intermediate friction elements constitute the supports between barge and keel and have a friction coefficient that will impede the sliding movements between the barge and the keel caused by external forces acting upon the barge, such as waves, currents, and winds, and also will impede sliding movements from accelerations of the keel caused by small earthquakes, but allowing these sliding movements, however, in the case of large earthquakes.

For their part, the elastic elements have an elasticity constant that will decrease in discrete degrees when the magnitude of the sliding movements between barge and keel surpasses certain predetermined values. Therefore, as the intensity of the earthquake increases, the oscillation period of the barge on the keel also increases, and amplification due to resonance of the sliding movements is avoided.

The elastic elements thus reduce the effects of the earthquake on the installations mounted on the barge, at the same time acting as recuperative elements, functioning so that the barge, following each displacement with regard to the keel, will reoccupy a position near the preferred theoretical position. Thus, accumulated displacements of the barge are impeded, and, in the same manner, its position within certain predefined limits is also maintained.

The intermediate friction elements may be made by a simple wedge mechanism placed between the barge and keel, e.g., on supports in the form of boat skids, extending out of the roof of the keel. These mechanisms are made of two horizontal facing wedges connected to each other by friction pins which bring the wedges together or pull them apart.

The two wedges are mounted between two blocks, one lower and the other higher, made of a rigid material such as steel. The blocks present inclined surfaces on the sides facing parallel to the inclined surfaces of the wedges so that the inclined surfaces of the blocks may be propped on the inclined surfaces of the wedges. The external opposite sides of the blocks are appreciably horizontal.

With this mechanism acting on the connector pins of the two wedges, the blocks may be separated so that the wedges are either brought together or pulled apart.

Each of the described mechanisms is finished with a stratum of deformable elastic material with a high friction coefficient, e.g., an elastomer, placed following one of the described blocks, while following the other block, there are one or more stratum of a material that will reduce the friction coefficient between said block and the prop-facing surface of the barge or keel. To the side of the layer or layers used to reduce the friction there is also a protective mantle going from the block adjacent to the layers all the way to the barge or keel with which the particular layer is in contact. This mantle serves to protect the surfaces in contact from possible deteriorations due to environmental conditions.

The stratum that reduces friction between the barge or keel and the adjacent block of the friction element may comprise a stainless steel plate fixed into the prop surface of the barge or keel, as well as a polytetrafluorethylene layer placed between said steel plate and the adjacent block.

With this system, there is uniform support throughout the boat skids of the keel.

The elastic elements are each comprised in a bundle of independent steel bars which partially cross the barge and keel vertically and which move freely. Each elastic element also contains an equal number of steel plates placed perpendicularly to the bars, half of which are placed on the barge while the other half go into the keel. They are soldered on the planks of the barge and on planks anchored to the keel.

The plates are symmetrically separate from each other with respect to the intermediate plane between the barge and the keel.

The plates have orifices through which the freely moving bars pass. Thus, the plates will be rather loose with respect to the division of the bars. This looseness must be minimal so that, when the bars deform by the effects of movements of the barge with respect to the keel, they will lean against the edges of the orifices, forcing the plates to break. The bars have a head or butt end on their upper extremity by which they are connected to the higher of two plates fixed into the barge.

The separation between the plates and the size of the bars, as well as the solder of the plates to the planks anchored to the barge and keel, is such that when displacements between barge and keel increase beyond certain prefixed values, due to the effects of an earthquake, they successively rupture the solder of the pairs of symmetrical plates, one on the barge and one on the keel, beginning with the pair of plates nearest each other, thus diminishing, in discrete degrees, the elasticity constant of the elastic elements.

As in the case of the friction elements, the elastic elements are also covered by a protective deformable mantle placed over the plates of the elastic elements on either side. The coverings consist of tubes through which the adjusted bars pass, e.g., by means of clasps placed upon these tubes, thus impeding oxidation of the cross zones of the plates and bars due to environmental conditions.

The barge zone through which the bars of the elastic elements pass, as well as the zone where the columns or boat skids for the friction elements are placed, is surrounded by two near and parallel walls high enough to reach close to the bottom of the barge to a sealed juncture, thus obtaining a watertight peripheral chamber between the two abovementioned walls.

This peripheral chamber assures that the central area, where the friction and elastic elements are located, will remain watertight, so that the elements are more easily accessible and may be adjusted wherever necessary. The barge may also have a wall running the width of its main geometric shafts between the endmost wall of the two peripheral walls mentioned above, thus subdividing both the peripheral chamber and the central chamber into a series of independent chambers.

The watertight juncture, mounted on each of the above-mentioned walls, contains a band of elastic material mounted by one of its longitudinal edges onto a rigid support from which the band extends. The support is anchored to a longitudinal iron plate extending beyond the top of each wall by means of threaded bolts. The bolts interpose the elastic material juncture between the support and the narrow plate so that the support and the band of elastic material remain facing outwards at a height such that the bottom of the barge is propped on the free longitudinal edge of the band when the barge is resting on the intermediate friction elements. Thus, the band, support, and narrow plate run along the width of each wall.

The support consists of an angular cross section, one wing of which is approximately horizontal, while the other wing faces towards the wall. The first wing binds the band of elastic material on its external side. The band is mounted between this wing and a metallic band penetrated by threaded bolts which connect the three elements perpendicularly. The other wing is bound to the narrow plate extending from the wall, by means of other threaded bolts, with the interposition of a narrow strip of elastic material, such as rubber. The cross section of the strip is trapezoidal shaped with the larger base of the trapezoid directed parallel to the top of the wall.

The band of elastic material becomes wider throughout the length of its free end, and this widening is directed towards the bottom of the barge. Thus, the band presses against the bottom of the barge when the barge is resting on the keel.

Although up to this point the combined use of the friction elements and the elastic elements have been described in their application to a marine platform, the possibilities of their application are very extensive and this must be considered in regard to the protection of the invention. Thus, the mounting system described constitutes an excellent foundation system floating on land, in seismic zones, etc., for any type of building, industry, etc.

When the described system is used on land as a floating foundation in seismic zones, the barge is limited to a base plate on which the installation is placed or constructed, and it is assumed that the keel will not require either ballast tanks or the double peripheral vertical walls with the watertight juncture. Thus, each wall may be reduced to the traditional slab.

The plate rests on the keel or slab by means of the friction elements described; the plate and the outer-periphery of the keel or slab are connected by the elastic elements described.

The effects obtained with this type of foundation in seismic zones are the same as those described previously for the barge, i.e., the effect of the earthquake on the installation or building mounted on the plate is reduced, and, at the same time, the position of the base plate of the building is controlled and its position is assured within acceptable limits, so that, after each possible displacement of the plate with respect to the keel or slab, said plate returns to its previous position.

DESCRIPTION OF THE DRAWINGS

The constructional characteristics are explained more clearly in the following description with references to the attached drawings, wherein a possible mode of operation is shown in schematic form and in the way of an unlimited example.

FIG. 6 is a side view according to direction C of FIG. 5.

FIG. 7 is a plan view of FIG. 6.

FIG. 8 is an enlarged scale detail showing a cross section of the two vertical peripheral walls of the keel with the watertight juncture.

FIG. 9 shows an alternate embodiment of the keel with respect to the watertight juncture.

DESCRIPTION OF THE PREFERRED EMBODIMENT

Figure 1:
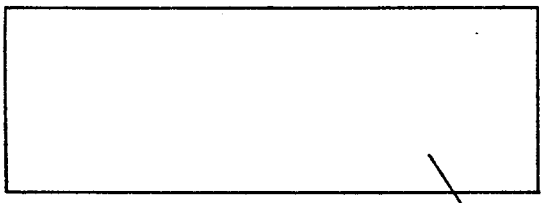
FIG. 1 is a view of a platform constructed in accordance with the invention.
Figure 2:
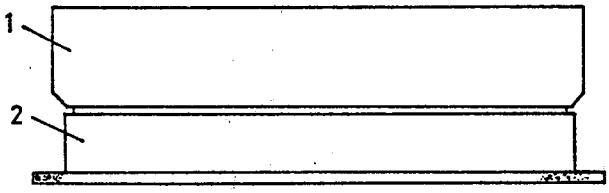
FIGS. 2 and 3 are a side and a front elevational view, respectively, of the barge resting against the ocean floor.
Figure 3:
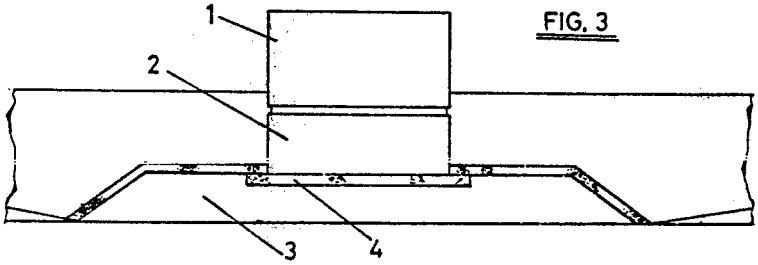

FIGS. 1, 2, and 3 represent a platform comprising an upper barge 1 and a lower keel 2. Both the barge and the keel have ballast tanks so that both elements may be constructed somewhere other than their working location. Thereafter, they may be transported by flotation to a new site. By filling the ballast tanks, the keel 2 is positioned firmly and the barge 1 is settled onto said keel. Should a perfect alignment of the keel to the ocean floor be necessary, the latter may be previously prepared with a first lower layer 3 of stone and an upper second layer of gravel 4 upon which keel 2 is placed.

The height of keel 2 shall be such that barge 1 is able to float over the keel when the ballast tanks are empty. When the tanks are full, the barge rests on the keel.

In accordance with the invention, barge 1 and keel 2 are interconnected by means of a series of intermediate friction elements and a series of elastic elements.

Figure 5:
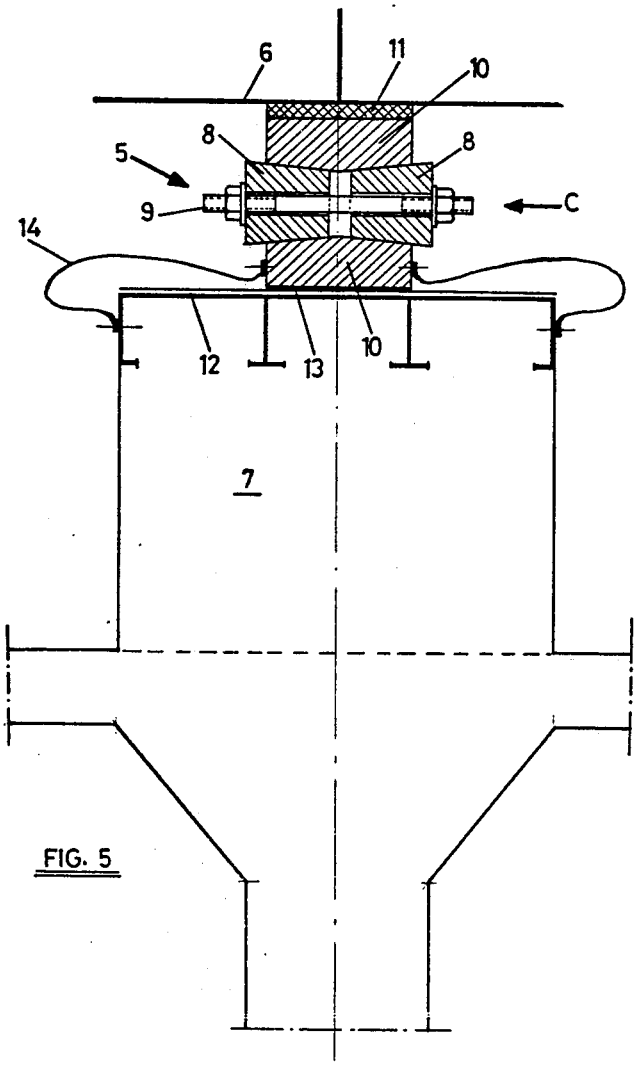
FIG. 5 is a detail that shows one of the friction elements in elevation.

The friction elements are represented in FIGS. 5, 6, and 7, in general by reference number 5 of FIG. 5.

Figure 4:
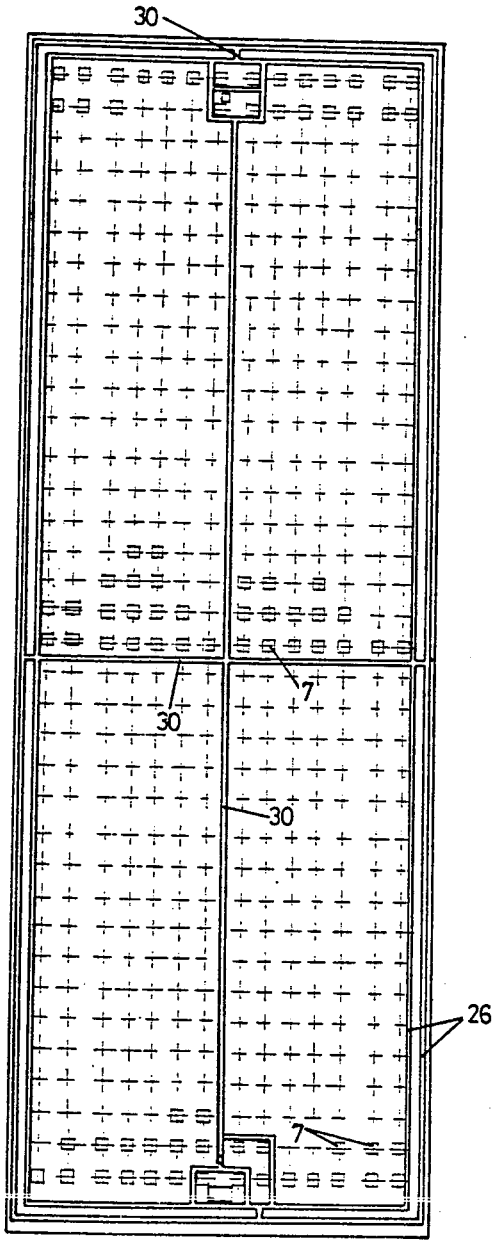
FIG. 4 is a plan view of the keel on an enlarged scale.

These friction elements are placed between the bottom 6 of the barge and props 7 in the form of a boat skid formed on the top surface of keel 2, as may be seen in FIGS. 4 and 5.

As may be seen in FIGS. 5 to 7, the friction elements are made up of two facing horizontal wedges, represented by reference number 8, interconnected by means of threaded bolts 9. The wedges 8 are mounted between blocks 10 from above and below. The wedges are made of a rigid material such as steel. The blocks 6, as they are clearly seen in FIG. 5, have inclined facing surfaces parallel to the inclined surfaces of the wedges so that the blocks 10 may rest against the wedges 8. The opposite sides of blocks 10 are appreciably horizontal.

In the described example, on upper block 10 there is a stratum of a very deformable elastic material with a very high friction coefficient, e.g., an elastomer, represented by reference number 11, while below lower block 10, there are one or more layers of a material that will reduce the friction coefficient between the block and the resting surface of boat skid 7 of the keel. These layers may comprise, e.g., a plate of stainless steel 12 fixed to the top surface of boat skid 7 of the keel 2 and a layer of polytetrafluorethylene 13 placed between the plate 12 and the lower block 10. Both plates 12 and 13, designed to reduce friction, are isolated by means of a protective mantle 14 fixed on one side to lower block 10 and on the other side to the lateral surface of boat skid 7.

With the described construction, by adjusting the bolts 9, wedges 8 may be brought closer or separated, which respectively cause blocks 10 to approach or separate so that the barge 1 rests uniformly on the keel 2 because of the friction elements 5.

The friction coefficient of the intermediate friction elements 5 is such that, when the barge 1 is resting upon the keel 2 with full ballast tanks, they impede relative displacements between the two, which displacements are caused by external forces acting on the barge 1, such as waves, currents, and winds, or by accelerations of the keel 2 due to earthquakes of small magnitude. However, these intermediate friction elements 5 allow displacements of the barge 1 with respect to the keel 2 when the earthquakes are of great magnitude.

Figure 11:
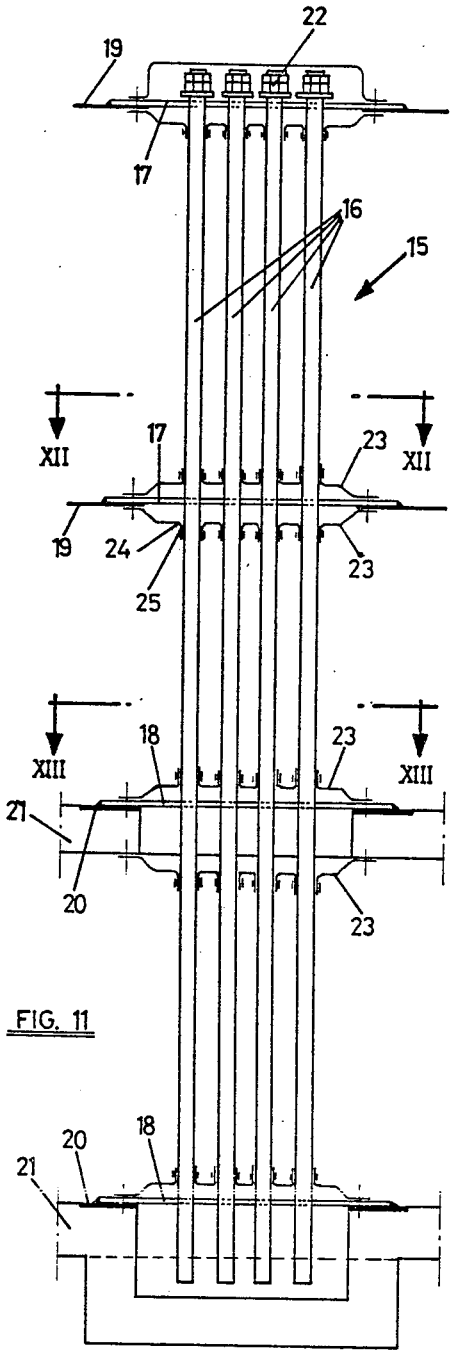
FIG. 11 shows a side elevational view of one of the elastic elements.
Figure 12:
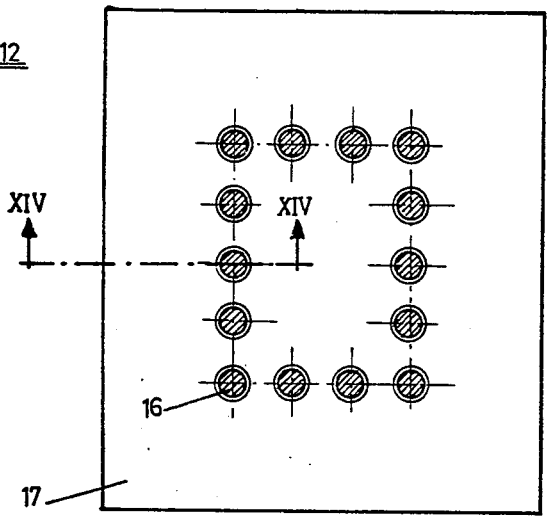
FIGS. 12 and 13 show cross sections through lines XII—XII and XIII—XIII, respectively, of FIG. 11.
Figure 13:
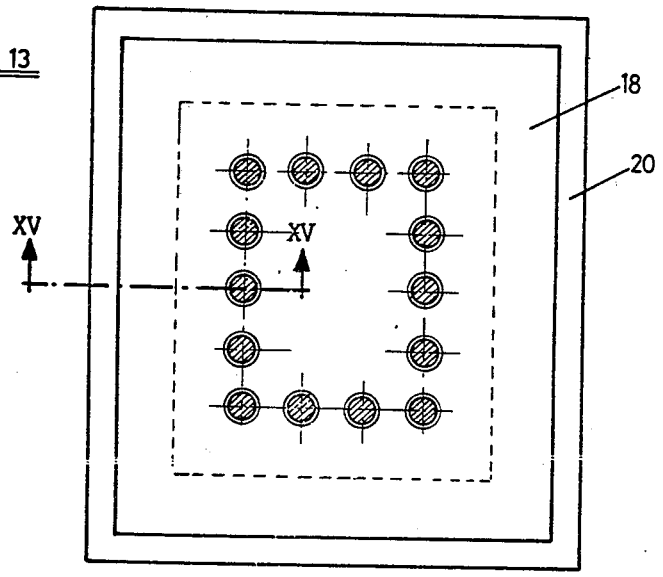
Figure 14:
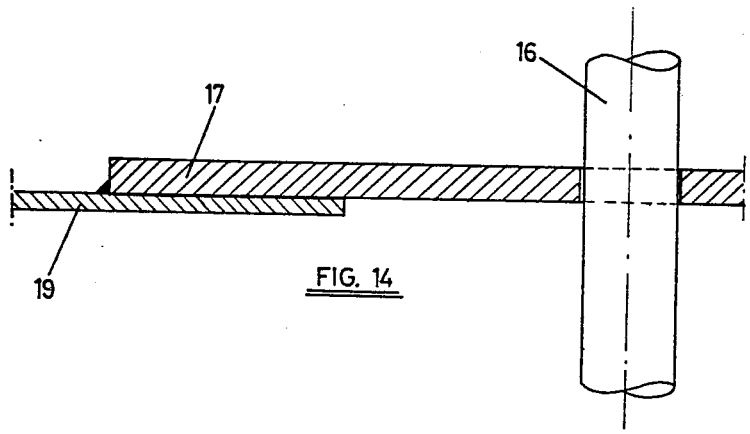
FIG. 14 shows a cross sectional view through lines XIV—XIV of FIG. 12.
Figure 15:
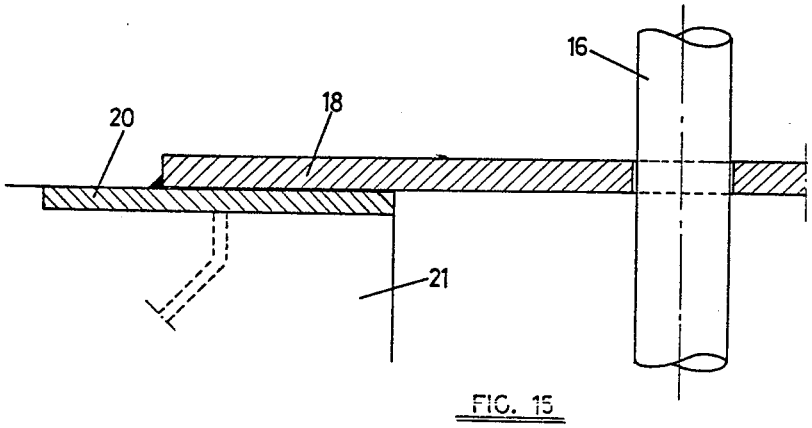
FIG. 15 shows a cross sectional view through lines XV—XV of FIG. 13.

Next we will describe the construction of the elastic elements represented in FIGS. 11 to 15, in general by reference number 15 of FIG. 11.

Each of the elastic elements 15 is made up of a bundle of independent steel bars represented by reference number 16. These bars 16 partially cross the barge 1 and keel 2 vertically and have freedom of movement. The intersection of bars 16 with the barge 1 and keel 2 takes place through a series of an equal number of steel plates 17 and 18, half of which (number 17) are fixed into the barge, while the other half (number 18) are fixed into the keel 2. Plates 17 are soldered on planks 19 of the barge 1 while plates 18 are soldered on sheets 20 anchored to walls 21 of the keel 2.

Plates 17 and 18 are separated symmetrically with respect to the intermediate plane located between the barge 1 and keel 2.

Sheets 19 and 20 have orifices through which the freely moving bars 16 pass through.

As may be seen in FIG. 11, the bars 16 have a head or butt end 22 on top by which they are attached to the highest upper plate 17 fixed to the barge 1.

The separation between the different plates 17 and 18, the section of the bars 16, and the solder between the plates 17 and 18 and the sheets 19 and 20, is such that, when displacements between barge 1 and keel 2 go beyond a certain preset value due to earthquakes, they successively break the pairs of symmetrical plates, one 17 of the barge 1 and one 18 of the keel 2 beginning with the pair of plates nearest each other, i.e., closest to the intermediate plane.

Under this condition, the elasticity content of the elastic element 15 decreases in discrete degrees.

As may be seen in FIG. 11, on top of plates 17 and 18, on either side, there are deformable protective mantles 23 which have tubes 24 through which bars 16 pass. Tubes 24 adjust to the bars 16 by means of, e.g., clamps 25, which impede oxidation of the cross zones between the bars 16 and the plates 17 and 18.

As may be seen in FIGS. 4 and 8, keel 2 has two parallel and near walls represented by reference number 26 on its upper side, surrounding the entire zone where the friction elements 5 and the elastic elements 15 are located.

The two walls 26, as best seen in FIG. 8, extend near to the bottom 27 of barge 1 when said barge 1 is resting on the keel 2. Between the tops of walls 26 and the bottom of the barge 1 there is a sealed juncture, represented in general by reference number 28 in FIG. 8. This sealed juncture 28 defines a peripheral watertight chamber 29 between walls 26 and the bottom 27 of the barge 1.

As represented in FIG. 4, the keel 2 can be equipped with two walls 30 on its upper side, which walls 30 run along the main shafts of the keel 2. Each wall 30 is equal in height to walls 26 so that the surface of the keel 2, limited by walls 26, is divided into a series of independent spaces.

As may be understood, the entire central surface of the keel 2, limited by walls 26, constitutes a very accessible water-tight chamber 29 that allows adjustment of the friction elements 5 or elastic elements 15 at anytime.

As may be seen in FIG. 9, walls 26 may be equipped with a double watertight element 28 on the upper surface.

Figure 10:
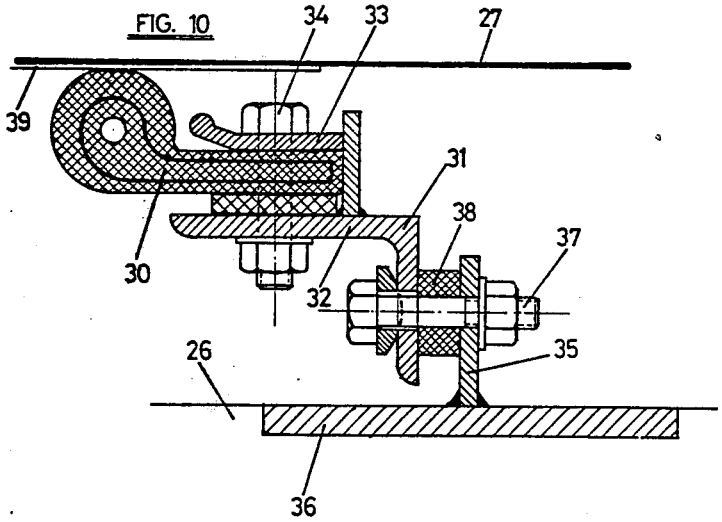
FIG. 10 shows the watertight juncture of FIGS. 8 and 9 on an enlarged scale.

The watertight element 28 may adopt any position, e.g., such as that shown in FIG. 10. According to this embodiment, each sealed juncture 28 contains a band of elastic material 30 that is mounted by one of its longitudinal edges on a rigid support comprising an angular cross section 31, one wing 32 of which is practically horizontal, while the other wing points towards wall 26. The band of elastic material 30 is fixed to wing 32 between wing 32 and a narrow plate 33 by means of bolts 34. The other wing points to wall 26 and is fixed to a plate 35 which is attached to wall 26, e.g., by means of plate 36 anchored to said wall 26. The positioning of this other wing is accomplished by means of bolts 37 with the interposition of a strip of elastic material 38 which, although it appears uniform in its design, is actually wider along its lower part so that, when bolts 37 are tightened, they push up angular cross section 31.

The effect of the strip of elastic material 38 and the pressure exerted by the water on band 30 is that the latter remains tightly pressed against bottom 27 of barge 1 in a zone that may immediately be resiliently sealed against stainless steel plate 39.

As may be understood, the watertight element 28 runs along the top of walls 26.

As has been indicated previously, the entire arrangement described may also be applied to land foundations in seismic zones, thus obtaining a floating foundation capable of withstanding earthquakes of great magnitude. In such a case, the barge 1 would be limited to a plate 39 upon which the construction or installation is built while the lower keel 2 would not be equipped with ballast tanks, using instead the normal construction for keels or foundation slabs. Also, the keel 2 could do without the peripheral walls 26 and the watertight elements 28.

Having described the nature of the invention and the manner in which it is applied to a sufficient degree, it must be noted that the embodiments indicated above may be modified without altering the basic concept of the invention.

What is claimed is:

1. A marine platform to support industrial installations which comprises:

a barge;

a lower keel on which said barge rests and which keel is positioned on the ocean floor;

intermediate friction means, situated between contact surfaces of the barge and keel;

elastic means, interconnected to the barge and keel, for opposing displacements between said barge and keel;

wherein said displacements are controlled because the friction resulting from the intermediate friction means impedes movements between said barge and keel caused by external forces acting on the barge, such as waves, currents, and winds, and caused by effects of acceleration on the keel induced by earthquake of small magnitude;

said intermediate friction means having means for permitting displacements between said barge and keel in the case of an earthquake of great magnitude;

said elastic means having means for decreasing the elasticity constant in discrete degrees when the displacements surpass a predetermined value so that, as the intensity of the earthquake increases, the oscillation period of the barge on the keel increases too but amplification of said oscillation period is avoided.

2. Platform according to claim 1, wherein said means for permitting displacements include two facing horizontal wedges interconnected by threaded bolts;

said wedges being mounted between an upper and a lower block which is made of a rigid material;

said blocks having inclined surfaces on their sides facing parallel to inclined surfaces of the wedges so that the wedges may rest against the blocks, while external opposite sides of the blocks are appreciably horizontal in order to allow said bolts to vary the separation between the wedges and the blocks;

each intermediate friction means further having a mantle of elastic material which is deformable and of a high friction coefficient, said mantle being placed following one of said blocks;

each intermediate friction means further having, following the other block, at least one layer of a material that reduces friction on one side between said block and a contact surface on one of the barge and keel; and a protective mantle being placed on the other side of the one layer and being run the entire length of the block, said protective mantle also protecting contact surfaces from deterioration by the environment.

3. Platform according to claim 2 further comprising:

a plate of stainless steel fixed to a contact surface between the barge and keel; and a polytetrafluorethylene layer placed adjacent to the plate of stainless steel.

4. Platform according to claim 1, wherein said means for decreasing the elasticity constant includes:

a bundle of independent and freely moving bars that partially cross the barge and keel vertically, said bars having a head or butt end on their upper extremity by which they remain fixed to the barge;

a series of an even number of symmetrical plates perpendicular to said bars, half of which are fixed to the barge and the other half to the keel; and sheets remaining separated from one another symmetrically with respect to said plates, said sheets having orifices through which the freely moving bars pass;

whereby the separation between the plates and the bars is such that, when the displacement between barge and keel surpass certain predetermined values, the symmetrical plates are successively broken, one on the barge side and one on the keel side, beginning with the plates nearest each other, thus decreasing the elasticity constant of the elastic means by discrete degrees.

5. Platform according to claim 4, further comprising:

deformable protective layers arranged above the symmetrical plates on both sides and equipped with tubes through which the bars pass, said tubes being adjustable with respect to the bars by means of clasps in order to impede oxidation of cross zones between the plates and the bars by the environment.

6. Platform according to claim 1, further comprising:

two parallel inner walls on the upper part of the keel, said walls surrounding a zone where the intermediate friction means and the elastic means are located, said walls extending near the bottom of the barge when said barge is resting on the keel; and a sealed juncture means for defining a watertight chamber between the two walls, said watertight chamber being located between each of the walls and the bottom of the barge.

7. Platform according to claim 6, wherein each sealed juncture means includes:

a band of elastic material that has a free longitudinal end and is mounted by the other longitudinal end on a rigid support extending out over said other longitudinal end;

a longitudinal plate means, running along the top of each wall, for anchoring said rigid support; and a strip of elastic material, interposed between the rigid support and the longitudinal plate means, so that the rigid support and the band of elastic material are facing outwards;

whereby the rigid support and the band of elastic material are situated at a height such that the free longitudinal edge of the band presses against the bottom of the barge when the barge is connected to the keel by the intermediate friction means.

8. Platform according to claim 7, wherein:

said rigid support includes an angular cross section, one wing of which is almost horizontal, while the other wing is directed perpendicularly to the top of the wall;

said first wing carrying the band of elastic material on its external side;

said band of elastic material being mounted between said first wing and a metallic band;

said first wing being bound to said band of elastic material by threaded bolts that are perpendicularly connected thereto; and said second wing being connected to the longitudinal plate means by other threaded bolts.

9. Platform according to claim 8, wherein:

said strip of elastic material is further interposed between said threaded bolts, said strip being trapezoidal in shape with a larger trapezoidal base directed parallel to the top of the wall.

10. Platform according to claim 9, wherein:

said free longitudinal end of the band of elastic material becomes wider along its length which is directed towards the bottom of the barge;

whereby said widened free longitudinal end causes the band of elastic material to press against the bottom of the barge when the barge is connected to the keel.

11. Platform according to claims 5 or 9, wherein the barge is equipped with ballast tanks.

* * * * *